US009656508B2

(12) United States Patent
Moeck

(10) Patent No.: US 9,656,508 B2
(45) Date of Patent: May 23, 2017

(54) PENCIL HOLDER FOR STORING A PENCIL

(71) Applicant: Gerhard Moeck, Kirchehrenbach (DE)

(72) Inventor: Gerhard Moeck, Kirchehrenbach (DE)

( * ) Notice: Subject to any disclaimer, the term of this patent is extended or adjusted under 35 U.S.C. 154(b) by 294 days.

(21) Appl. No.: 14/454,751

(22) Filed: Aug. 8, 2014

(65) Prior Publication Data

US 2015/0041350 A1 Feb. 12, 2015

(30) Foreign Application Priority Data

Aug. 8, 2013 (DE) ..... 10 2013 013 146

(51) Int. Cl.

| | |
|---|---|
| ***B65D 69/00*** | (2006.01) |
| ***B43K 23/00*** | (2006.01) |
| ***B43K 23/10*** | (2006.01) |
| ***B43K 25/02*** | (2006.01) |
| ***B43L 23/08*** | (2006.01) |

(52) U.S. Cl.

CPC ..... *B43K 23/001* (2013.01); *B43K 23/10* (2013.01); *B43K 25/026* (2013.01); *B43L 23/08* (2013.01)

(58) Field of Classification Search

CPC ..... B43K 23/001; B43K 23/06; B43K 23/08; B43K 23/10; B43K 25/026

USPC ..... 206/38, 224, 234, 306, 371; 24/11 CC, 24/11 CT; 401/88, 195, 266

See application file for complete search history.

(56) References Cited

U.S. PATENT DOCUMENTS

| | | | | |
|---|---|---|---|---|
| 196,676 A | | 10/1877 | Lake | |
| 496,269 A | | 4/1893 | Mazza | |
| 895,019 A | | 8/1908 | Hopkins | |
| 965,235 A | | 7/1910 | Selleck | |
| 1,097,357 A | * | 5/1914 | Paulson | B43K 23/001 24/11 CT |
| 1,299,923 A | | 4/1919 | Easton | |
| 1,500,056 A | | 7/1924 | Conover | |
| 1,728,128 A | | 9/1929 | Kodama | |
| 1,916,889 A | * | 7/1933 | Moulton | B43L 23/08 15/105.53 |
| 1,921,270 A | | 8/1933 | Talt | |
| 1,932,486 A | | 10/1933 | Rohwedder | |
| 2,114,203 A | * | 4/1938 | Agbayani | B43K 23/10 15/435 |
| 2,501,295 A | | 3/1950 | Stone | |
| 3,317,274 A | * | 5/1967 | McCormick | G01K 1/083 206/212 |
| 3,941,237 A | * | 3/1976 | MacGregor, Jr. | B08B 9/28 198/690.1 |

(Continued)

FOREIGN PATENT DOCUMENTS

| | | | |
|---|---|---|---|
| CH | 195681 A | 2/1938 | |
| DE | 1772416 U | 8/1958 | |

(Continued)

*Primary Examiner* — Luan K Bui

(74) *Attorney, Agent, or Firm* — Laurence A. Greenberg; Werner H. Stemer; Ralph E. Locher

(57) ABSTRACT

A pencil holder for storing a pencil includes a hollow basic body which has an elongated interior that opens out in an insertion opening for partially receiving the pencil. In the region of the insertion opening the basic body merges into a least one retaining tongue which juts out from the basic body in the longitudinal direction and which is set up for the purpose of holding the pencil on the basic body as a result of clamping.

18 Claims, 8 Drawing Sheets

(56) References Cited

U.S. PATENT DOCUMENTS

| | | | | | |
|---|---|---|---|---|---|
| 5,186,326 | A * | 2/1993 | Peckels | A45F 5/02 | 206/234 |
| 6,092,293 | A * | 7/2000 | Donaldson | B43L 23/08 | 30/457 |
| 6,149,332 | A | 11/2000 | Huang | | |
| 2004/0154172 | A1 * | 8/2004 | Tatz | B43K 23/10 | 30/457 |
| 2006/0029460 | A1 | 2/2006 | Russo | | |

FOREIGN PATENT DOCUMENTS

| | | | | | |
|---|---|---|---|---|---|
| DE | 69506392 | T2 | | 8/1999 | |
| DE | 202007001572 | U1 | | 6/2008 | |
| EP | 1953003 | A2 | | 8/2008 | |
| FR | 484525 | A | | 10/1917 | |
| FR | 2797803 | | * | 3/2001 | B43K 23/10 |

* cited by examiner

PENCIL HOLDER FOR STORING A PENCIL

BACKGROUND OF THE INVENTION

Field of the Invention

The invention relates to a pencil holder for storing a pencil, in particular a carpenter pencil.

Traditionally, pencils that can be sharpened, in particular so-called carpenter (lead) pencils are used for marking purposes in the trade sector. In the majority of cases such pencils are wooden or plastic coated pencils which have to be sharpened by means of a sharpener or a blade in order to expose the writable lead and to produce a sufficiently sharpened writing tip. The fact that such pencils become increasingly shorter in use as a result of repeated sharpening makes it difficult in particular to store/hold said pencils so they are ready to hand. On the one hand, when they are used in the trade sector there are frequently no flat surfaces within reach on which the pencil could be placed. On the other hand, a pocket, for example a trouser or jacket pocket, or a (pencil) holder, as is known, for example, from DE 695 06 392T2, is only partially suitable for holding such a pencil that can be sharpened. Once shortened sufficiently, such a pencil namely always tends to disappear completely in the pocket or the holder such that the pencil is then no longer easily to hand.

BRIEF SUMMARY OF THE INVENTION

The object underlying the invention is to provide a simple possibility for holding a pencil so that it is permanently ready to hand.

Said object is achieved according to the invention by a pencil holder as claimed. Advantageous embodiments and further developments of the invention, some of which are inventive per se, are provided in the sub-claims and the following description.

The pencil holder according to the invention includes a hollow sleeve-shaped basic body which comprises an elongated interior which opens out in an insertion opening for partially receiving the pencil. In the region of the insertion opening the basic body merges according to the invention into a least one retaining tongue which juts out from the basic body (preferably in the longitudinal direction) and which is set up and provided for the purpose of holding the pencil on the basic body as a result of clamping.

The pencil is preferably a pencil that can be sharpened, such as, for example, a traditional lead pencil or crayon. In particular, the pencil is a so-called "carpenter pencil" which is used regularly by tradesmen to mark the courses of cuts and/or bores on workpieces. As an alternative to this, within the framework of the invention the pencil can also be a different type of pencil, such as, for example, a fiber pen etc.

For "partially receiving the pencil" means here and below that, as a rule, only a part portion, in particular a front part that bears the pencil tip, of the pencil is received in the interior of the basic body, whilst the remaining part portion of the pencil projects out of the basic body. In said case, the hollow basic body advantageously prevents the writing tip of the pencil being exposed. Consequently, the pencil holder avoids the clothing of the user becoming accidentally soiled.

For the case where the pencil holder comprises just one retaining tongue, said retaining tongue preferably clamps the pencil against a wall of the basic body. The retaining tongue, in this connection, is formed, for example, by two longitudinal slots which are introduced into the wall of the basic body, and is consequently developed in a defined and flexible manner—i.e. resiliently—in relation to the wall against which the pencil is clamped.

By the pencil being clamped by the (single) retaining tongue, the pencil is always held in the pencil holder in precisely the position chosen by the user—in particular at the desired depth of insertion with reference to the insertion opening. Consequently even pencils that are arbitrarily short do not fall into the pencil holder but are held with sufficient projection beyond the edge of the holder, which defines the insertion opening, i.e. in particular beyond the free end of the or of each retaining tongue in order to be able to grip the pencil and to pull it out of the pencil holder at any time so it can be used again.

In principle, within the framework of the invention, an arbitrary number of retaining tongues can be arranged on the basic body. In a preferred realization the basic body merges, however, into two retaining tongues which are located opposite one another (diametrically over the longitudinal axis) and which are set up for the purpose of holding the pencil between them as a result of clamping. As a result of the two retaining tongues, the flexibility of the pencil holder for holding different pencils, in particular pencils with differently sized cross sectional areas, is advantageously increased.

When two retaining tongues are arranged on the basic body, said two retaining tongues are spaced apart from one another such that, as an option, a user is able to grip with two fingers to remove the pencil from between the retaining tongues. As a result, even pencils that have slipped or have been wrongly placed too deep in the basic body are able to be removed.

The basic body is preferably developed in such a manner that the largest expected pencil diameter—in the case of pencils with a non-round cross section the largest pencil cross section to be expected—is able to be received in the interior. The largest pencil cross section preferably corresponds to the cross section of a traditional (i.e. profiled in an oval or elliptical manner) carpenter pencil.

In a realization that is expedient as regards manufacturing, the pencil holder is produced from plastics material. Realization from plastics material makes it possible in a simple manner to realize the or each retaining tongue in a sufficiently flexible or resilient manner. In addition, the pencil holder can also be produced with a particularly high degree of creative freedom. Within the framework of the invention, it is nevertheless also conceivable for the pencil holder to be produced from metal, for example a light metal.

In an expedient realization of the pencil holder, the basic body is closed at its pointed end which is opposite the insertion opening. As a result, even when the pencil is inserted deeply into the basic body, the clothes in which the pencil holder is carried by the user, are prevented in a simple manner from being soiled by the writing tip of the pencil. As an alternative to this, however, it is also conceivable within the framework of the invention for the basic body to be realized open at its pointed end.

In an expedient realization the pencil holder comprises a fastening bracket which is connected to the basic body, is preferably integrally molded thereon, by way of an end that is designated as the "fixed end". By way of its free end which is remote from the fixed end, the fastening bracket, in this case, is aligned in the direction of the pointed end of the basic body. The fastening bracket makes it possible in an expedient manner to fasten the pencil holder—preferably with the insertion opening directed upward—on, for example, a pocket of the work clothes or the like and consequently in particular to the body. As a result, the pencil is able to be removed from the pencil holder and after use can be put back in said pencil holder in a simple manner, in particular with one hand. The pencil is consequently accessible, i.e. handy for the user at all times. This is advantageous, in particular, when the user uses one hand for applying and holding a ruler, a template or a workpiece. In such a case, a safer storage place for the pencil, for example an even surface, is frequently not within the reach of the user.

The fastening bracket is preferably developed in such a manner that its holding force (serving for retaining the pencil holder on the work clothes) exceeds the clamping force of the retaining tongues. The achievement is that the pencil is able to be removed out of the pencil holder without the pencil holder becoming detached from the work clothes. To this end, in an expedient realization the fastening bracket comprises at least one blocking element which is preferably arranged on the inside surface of the fastening bracket which faces the basic body and which "digs" into the material of the work clothes or the like in the manner of a barb and consequently counters inadvertent removal of the pencil holder. In a preferred manner, the fastening bracket comprises at least two blocking elements of this type which are arranged one after another in the longitudinal direction.

In an expedient realization, the fastening bracket is fastened, in particular integrally molded, by way of its fixed end on the retaining tongue (or on one of, where applicable, several retaining tongues). The fastening bracket, in this connection, is fastened on the retaining tongue in particular at a small spacing—compared to the length of the fastening bracket—from the insertion opening. In other words, the fastening bracket is connected to the respective retaining tongue preferably directly on or just prior to the pencil holder edge that defines the insertion opening. The achievement of said arrangement of the fastening, which will also be designated below as "located at the end", is that the pencil holder—which is stored as specified in a pocket of a work garment and is fastened by way of the fastening bracket on the edge of the pocket ("pocket edge")—only projects slightly beyond the pocket edge. As a result, the risk of the pencil holder catching on surrounding objects, and as a result being torn out of the pocket—where applicable damaging the same—is reduced.

In a preferred realization, the pencil holder comprises a length of approximately between 16 and 26 centimeters, preferably between 20 and 24 centimeters. The length of the pencil holder, in this connection, is dimensioned in particular in such a manner that it corresponds approximately to the length of a traditional, collapsed folding rule ("inch rule"). This is advantageous as in the case of usual work garments the depth of at least some pockets is frequently oriented to the length of a collapsed folding rule. Consequently, the correspondingly dimensioned pencil holder is also able to be stored securely in traditional work garments, without restricting the freedom of movement of the user.

In order to make it easier to introduce the pencil into the basic body, in an advantageous realization the one or each retaining tongue is bent out at the free end for enlarging the insertion opening in a funnel-shaped manner. As a result, it is possible for the user to operate the pencil holder in an almost "blind" manner, that is to insert the pencil into the pencil holder without looking to see exactly where it is going. In addition, as a result of the bending out of the retaining tongues, on insertion into the pencil holder each pencil is guided and centered in relation to the interior such that even particularly thick pencils are able to be inserted into the pencil holder in a simple manner, in particular without twisting.

In order to increase the elasticity of the or of each retaining tongue, in particular in order to provide the spring action of the or of each retaining tongue in a targeted manner, in an expedient realization the or each retaining tongue is tapered—preferably in portions—between the transition to the basic body and its free end. In this context "in portions" means that the or each retaining tongue is tapered simply over part of its entire length. For this purpose, the or each retaining tongue can be tapered in the circumferential direction (tangentially) and/or radially. In the latter case, the wall thickness of the or of each retaining tongue is tapered.

To strengthen the clamping action onto the pencil, in an expedient realization the or each retaining tongue comprises on its inside surface in each case at least one retaining projection which projects into the interior of the basic body. For the case where a pencil is inserted into the basic body, said retaining projection abuts against the outer surface of the pencil. Consequently, in an advantageous manner a pencil where the pencil cross section falls below the cross section of the basic body is also able to be held in the pencil holder without falling right into the said pencil holder.

In a preferred realization, the or each retaining tongue comprises on its inside surface in each case two retaining projections which, when viewed transversely with respect to the longitudinal direction of the basic body, are arranged spaced apart side by side. The use of two retaining projections enables, on the one hand, sturdy contact of the one or of each retaining tongue on the outer surface of the pencil. The abutting of the one or of each retaining tongue against just two discrete points on the pencil circumference makes it possible, on the other hand, to hold pencils with different profiles, i.e. in particular flattened profiles such as, for example, elliptical or oval profiles of carpenter pencils, as well as triangular, round or also hexagonal pencil profiles, in an equally sturdy manner centered with respect to the longitudinal axis of the pencil holder.

In order to prevent the pencil tilting out of the longitudinal axis of the pencil holder, the or each retaining projection, in an expedient realization, has a form which is elongated parallel to the longitudinal axis of the basic body. As a result of the elongated retaining projection (in this case also designated as a "clamping web"), in particular as a result of the clamping webs which are provided in twos per retaining tongue, the insertion of the pencil is made easier as the or each clamping web guides the pencil in the longitudinal direction. In particular in the case of two clamping webs per retaining tongue, the pencil is particularly effectively centered with reference to the longitudinal axis. In addition, the pencil is prevented from tilting. Consequently, even particularly short pencils, which do not reach into the interior—which is closed in a ring-shaped manner—of the basic body, are also able to be held sturdily (in a position-stable and tilt-resistant manner) between the retaining tongues.

In order to improve the guiding of the pencil in the longitudinal direction further and to prevent the pencil tilting in the basic body in a particularly effective manner, in a preferred realization the or each clamping web, proceeding from the or each retaining tongue, extends over more than 50% of the length ("inside length") of the interior of the basic body. The clamping webs are preferably dimensioned in such a manner that they extend over at least 70%, in particular between 80 and 95% of the inside length or even over the entire inside length.

In order to increase the clamping action of the retaining tongues onto the pencil further and in order, consequently, to prevent the pencil slipping off the retaining tongues or being shaken as a result of knocks and vibrations in the basic body, it is also conceivable within the framework of the invention for the or each retaining projection to be provided with a non-slip coating or to be realized from a non-slip material.

In an expedient realization, the basic body comprises an oval cross section. The term "oval", in this connection, refers to the cross section of the basic body comprising a larger extension in one direction than in a direction that is perpendicular thereto. The cross section of the basic body, in this case, is realized, for example, in a polygonal manner (in particular in the form of a rectangular) with rounded corners or in an elliptical manner. This is expedient in particular as the pencils with the largest cross sectional area are preferably carpenter pencils, the cross section of which is regularly also oval.

In an expedient realization, in the outer surface of the basic body, i.e. in the surface thereof which points toward the outside surface of the pencil holder, a depression is formed in which a sharpening blade for sharpening the pencil is fastened. The cutting edge of the sharpening blade, in this connection, when assembled as specified, is aligned substantially (i.e. precisely or almost approximately) parallel to the longitudinal axis of the basic body and in addition is accessible from the outside of the basic body. As a result, it is made possible, in particular, for the sharpening blade to be able to be used as a traditional (pocket or cutter) blade for sharpening the pencil. By the sharpening blade, when assembled as specified, being arranged on the pencil, it is also advantageously always available to the user of the pencil holder.

The depression for the sharpening blade, in this connection, is preferably arranged in the region of the pointed end of the basic body. The depression is additionally preferably formed in such a manner that the sharpening blade lies in the depression in a fitting manner and in particular clearly aligned (with reference to the position of the cutting edge as specified).

In a further expedient realization, the pencil holder includes a blade cover, by means of which the sharpening blade can be covered in a reversible manner.

By means of the blade cover, which is preferably realized in a sleeve-shape manner, the sharpening blade is always able to be covered whenever it is not required. Consequently, the sharpening blade, when not being used, is inaccessible from the outside such that injuries caused by unintentional contact with the cutting edge are effectively prevented. The blade cover is preferably produced from transparent material such that the sharpening blade is visible even in the covered state.

In a preferred manner, the blade cover is fastened on the basic body so as to be movable, i.e. in particular pushable or rotatable. In this case, the blade cover is preferably adjustable between two positions on the basic body, namely one protective position covering the sharpening blade and one sharpening position exposing the sharpening blade. However, the blade cover, when assembled as specified, is preferably not removable from the basic body—at least not without sufficient exertion of force. Consequently, loss of the sharpening blade is effectively prevented.

In order to be able to position the blade cover precisely on the basic body at least in the protective position, the basic body comprises in an expedient manner a stop against which the blade cover abuts in the protective position. A movement of the blade cover beyond the protective position is consequently blocked. Within the framework of the invention, in this case, it is conceivable for the basic body also to comprise a further stop, against which the blade cover abuts in the sharpening position.

In order to prevent the blade cover being moved unintentionally, for example when inserting the pencil holder into the pocket, out of the protective position or out of the sharpening position, the or each stop preferably has mounted upstream thereof a latching means. Such a latching means is, for example, a bulge-like curvature on the outer surface of the basic body, beyond which the blade cover, deforming slightly in an elastic manner, is moved up to the stop. The blade cover preferably comprises on its inside surface which faces the basic body an indentation, which corresponds to the depression and in which the curvature lies when the blade cover is arranged in the respective end position (that is the protective position or the sharpening position). As a result, the blade cover is secured in a simple manner against unintentional movement in its end position.

In a preferred realization, the blade cover is set up and provided for the purpose of being displaced between the protective position and the sharpening position in the longitudinal direction of the basic body along the outer surface thereof.

The blade cover, in this connection, is preferably realized in the form of a (protective) sleeve which is closed in a ring-shaped manner and surrounds the basic body. The or each stop, in this connection, is realized on the basic body in particular as a collar which extends around in a ring-shaped manner such that the blade cover abuts against said collar over the entire surface in the respective end position. The or each latching means, in this case, is preferably realized on the outer surface of the basic body as a circumferential latching ring.

In an alternative realization the blade cover is realized as a "C-shaped" shell which engages by at least 180 degrees around the basic body. In this connection, the blade cover comprises on its inside surface preferably two guide webs which are aligned in the longitudinal direction, by means of which the blade cover is clipped in corresponding guide grooves in the outer surface of the basic body and is guided so as to be displaceable in the longitudinal direction.

Within the framework of the invention, as an alternative to this the blade cover can also be realized as a sleeve with a window. In this connection, by rotating the blade cover about the longitudinal axis of the basic body, the sharpening blade is covered or exposed through the window.

Within the framework of the invention, it is additionally conceivable for the blade cover to be coupled with the basic body by means of a spring in such a manner that the blade cover is moved automatically from the sharpening position into the protective position, i.e. when the blade cover is not held manually in the sharpening position. As a result, a particularly high level of operating reliability is achieved for the pencil holder.

In a further preferred realization, the basic body comprises inside the depression a passage by means of which the depression communicates with a stop surface which is formed in the basic body on the rear side of the depression. The depression and the contact surface, in this case, are formed in such a manner that, when assembled as specified, the cutting edge of the sharpening blade is—preferably only—accessible from the contact surface for sharpening the pencil. During sharpening, the contact surface serves for the abutment and guiding of the pencil with reference to the cutting edge of the sharpening blade. The part of the basic body comprising the contact surface also serves in particular as an abutment surface for the sharpening blade.

In a particularly expedient realization, the cutting edge of the sharpening blade has mounted upstream thereof a frame web which extends substantially in the longitudinal direction of the basic body, by means of which a cutting thickness of the sharpening blade is provided—similarly to as in the case of a plane or a so-called "potato peeler". The term "cutting thickness", in this connection, refers to the cutting depth of the sharpening blade which is defined by the frame web, that is the maximum thickness of the shavings that can be shaved from the pencil to be sharpened by means of the sharpening blade. In said realization the depression that receives the sharpening blade—once again similarly to a plane or potato peeler—also serves as a shaving removal opening.

The frame web additionally serves as a contact protection which screens the cutting edge of the sharpening blade against contact by body parts or objects (e.g. work garments). The frame web is consequently present in a particularly preferred manner in the case of realizations of the pencil holder where a blade cover is not provided. However, a blade cover can also be provided as an option in the case of embodiments of the pencil holder where the frame web is present. In an advantageous manner, the frame web which is located opposite the sharpening blade additionally also serves for stiffening the basic body mechanically.

In principle within the framework of the invention, the frame web can be a component part of a metal frame—similarly to as in the case of a potato peeler—, in which the sharpening blade is incorporated as an integral or subsequently added component, and which is fastened as one unit on the basic body. The frame web, however, is preferably realized as an integral component of the basic body which defines in particular the depression as well as the passage to the contact surface on the side of the pencil holder facing the cutting edge. On the side of the frame web that is remote from the depression, a guide surface which is parallel to the contact surface is preferably formed for defining the cutting thickness. The cutting edge of the sharpening blade, in particular the free surface thereof, in this case, when assembled as specified, is preferably arranged substantially—i.e. precisely or with a slight deviation—in alignment with the contact surface. For sharpening, the pencil is placed transversely with respect to the longitudinal extension of the pencil holder onto the frame web and the contact surface and is pulled over the cutting edge. As a result of a defined offset between the frame web and the cutting edge or the contact surface, in this case, a shaving with a (fixedly) predefined thickness is shaved off the pencil. The offset is advantageously predefined so as to be slight in such a manner that soft objects such as body parts or textiles are protected against injury or damage on the cutting edge.

In order to prevent, in addition, dirt and/or liquid being collected in the interior of the basic body, in a further expedient realization one or several windows are formed in the outer surface of the basic body in the region of the pointed end. The interior communicates with the outside surface of the basic body by means of the or each window such that liquid (e.g. rain water in the case of an activity outside) and dirt particles such as, for example, sawdust, wood shavings or sand are able to escape from the interior to the outside.

BRIEF DESCRIPTION OF THE SEVERAL VIEWS OF THE DRAWING

Exemplary embodiments of the invention are shown in more detail below by way of a drawing, in which.

DESCRIPTION OF THE INVENTION

Parts which correspond to one another are always provided with the same references in all the figures.

Figure 1:
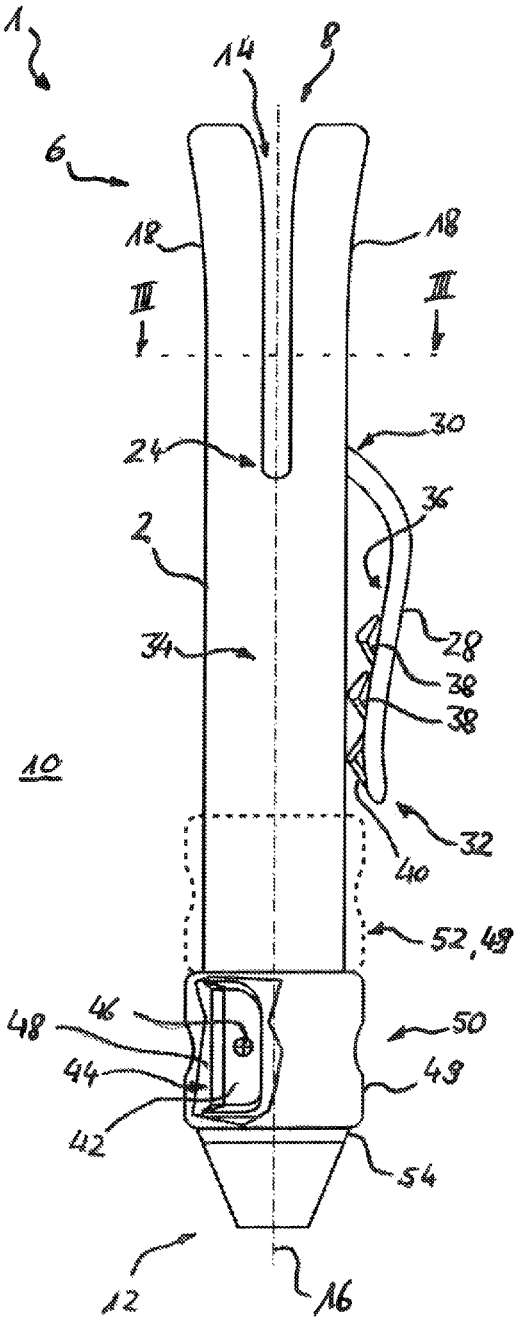
FIG. 1 shows a side view of a pencil holder for storing a pencil.
Figure 2:
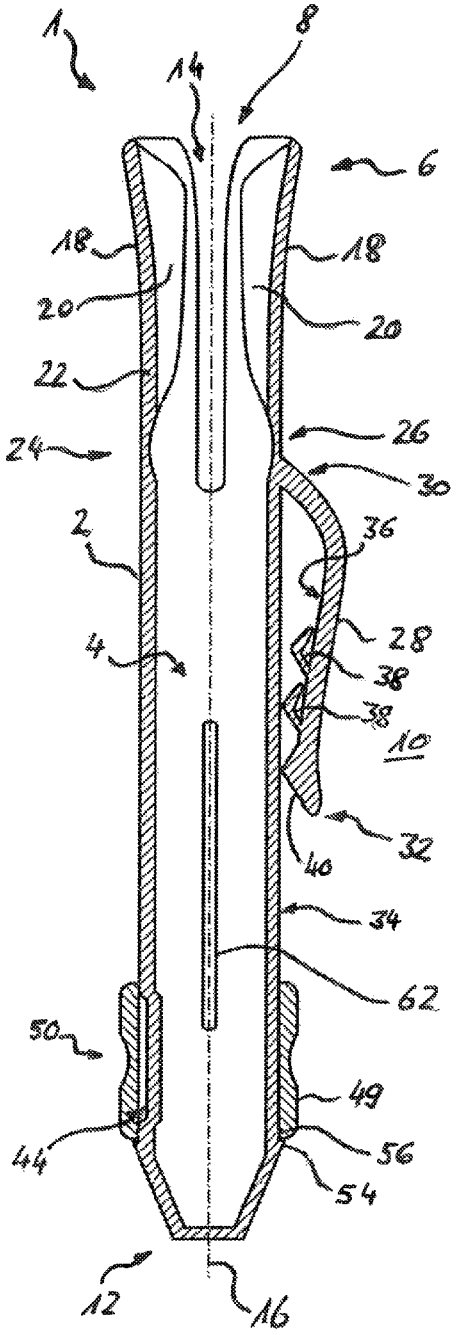
FIG. 2 shows a longitudinal section II according to FIG. 3 of the pencil holder.

FIG. 1 and FIG. 2 show a pencil holder 1 for holding a pencil. The pencil holder 1 comprises a hollow sleeve-shaped basic body 2 which encloses an elongated interior 4 for partially receiving the pencil. The interior 4, in this case, merges at one end of the pencil holder 1, which is designated as the insertion end 6, into an insertion opening 8. At the end located opposite the insertion end 6 (designated as the pointed end 12 below) the basic body 2 reduces in the manner of a cone and is closed toward the outside 10. In the region of the insertion end 6 the pencil holder 1 comprises two longitudinal slots 14 which are introduced in the manner of a cam of an arrow. The longitudinal slots 14 are located diametrically opposite the longitudinal axis 16 of the pencil holder 1. The longitudinal slots 14, in this case, form two retaining tongues 18, which are also located diametrically opposite one another, out of the basic body 2.

Figure 3:
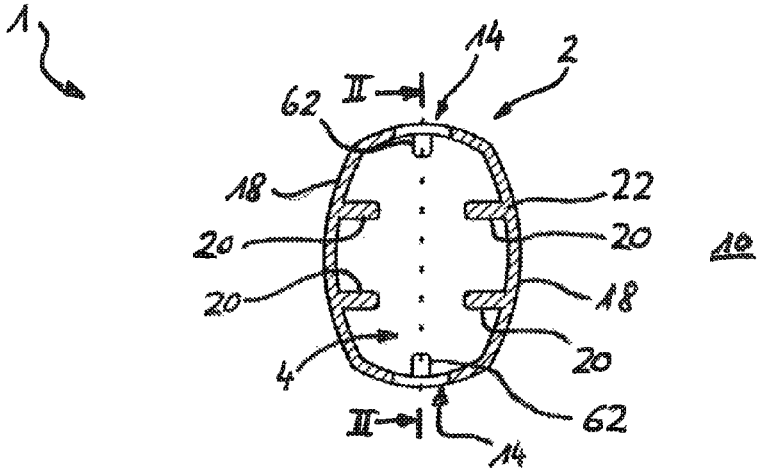
FIG. 3 shows a cross section III according to FIG. 1 of the pencil holder.

The retaining tongues 18 are bent out toward the outside 10 in the region of the insertion end 6 such that the insertion opening 8 is enlarged in a funnel-shaped manner in relation to the cross section of the interior 4 which extends over the majority of the basic body 2. In addition, the retaining tongues 18, as shown in FIG. 2 and FIG. 3, comprise in each case two retaining projections which are designated as clamping webs 20 and extend in each case in the manner of ribs in the longitudinal direction of the pencil holder 1 along the retaining tongues 18.

In order to develop the retaining tongues 18 in a flexible manner such that they are able to be bent out in a reversible manner (i.e. deforming elastically) toward the outside 10 for receiving the pencil, the wall 22 of the pencil holder 1 in the region of the retaining tongues 18, definitively in the region of the closed end 24 of the longitudinal slots 14, comprises a wall thickness tapering 26 (that is a wall region with a reduced wall thickness).

For fastening the pencil holder 1 on a support, for example on a pocket of the work garment of the user, the pencil holder 1 comprises a fastening bracket 28. The fastening bracket 28 is connected integrally to the basic body 2 by way of its end which is designated as the fixed end 30. The free end 32 of the fastening bracket 28 points in the direction of the pointed end 12. The fastening bracket 28, in this connection, extends bent in an S-shaped manner along an outside surface of the pencil holder 1 which is designated as the outer surface 34.

On an inside surface 36 which faces the outer surface 34 of the pencil holder 1, the fastening bracket 28 additionally bears two blocking elements 38 which are arranged one behind the other in the longitudinal direction. In addition, in the region of the free end 32 a substantially triangular retaining lug 40 projects from the inside surface 36 of the fastening bracket 28, the tip of said retaining lug abutting against the outer surface 34 of the pencil holder 1. The retaining lug 40 preferably serves for securing the pencil holder 1 on a comparably flat, hard object, for example on a piece of paper or cardboard. The blocking elements 38 serve in comparison preferably for supporting the pencil holder 1 on a soft flexible material, such as, for example, the material of the work garment. In said case, the blocking elements 38, in the manner of a barb, provide a particularly good hold against the pencil holder 1 being pulled off the work garment. As shown in FIG. 1 and FIG. 2, the blocking elements 38 are formed from one retaining leg which is connected integrally to the fastening bracket 28 and one free leg which is connected thereto and extends inclinedly with respect to the longitudinal axis 16. The free leg, in this case, comprises a comparably wide support surface for the material of the work garment such that a particularly high level of resistance against the pencil holder 1 being pulled off is provided without, at the same time, damaging or even tearing the material.

In order to keep a sharp blade always available for sharpening the pencil used with the pencil holder 1, in the assembled state of the pencil holder 1 shown, a blade which is designated as a sharpening blade 42 is arranged on the basic body 2. The sharpening blade 42, in this connection, is placed in position in a depression 44 which is formed in the outer surface 34 and is secured by means of a clamping screw 46. The cutting edge 48 of the sharpening blade 42, in this case, is aligned parallel to the longitudinal axis 16 of the pencil holder 1 and is accessible from the outside 10. The pencil can consequently be sharpened in a manner that is comparable to a cutter blade.

In order to protect the sharpening blade 42 from access when it is not being used and consequently to avoid injuries, the pencil holder 1 comprises a blade cover which is designated as a protective sleeve 49. The protective sleeve 49 is displaceable along the outer surface 34 between a protection position 50 shown in FIG. 1 and FIG. 2 and a sharpening position 52 indicated by the broken line in FIG. 1. In the protection position 50 the protective sleeve 49 completely covers the sharpening blade 42. In the sharpening position 52 the protective sleeve 49 is displaced so far in the direction of the insertion opening 8 along the basic body 2 that the sharpening blade 42 is completely exposed.

In order to hold the protective sleeve 49 precisely in the protective position 50 and to secure it from being stripped off the pencil holder 1, a circumferential stop (designated as a collar 54), which projects beyond the outer surface 34 approximately perpendicularly to the longitudinal axis 16, is integrally molded on the outside of the basic body 2. The protective sleeve 49 abuts against the collar 54 in the protective position 50. When viewed from the insertion opening 8, the collar 54 has mounted upstream thereof a latching means (designated as latching ring 56) which also extends around the basic body 2 in a ring-shaped manner. The latching ring 56 projects just slightly beyond the outer surface 34 such that the protective sleeve 49, when displaced into the protective position 50, is able to be pushed beyond the latching ring 56 as a result of a slight elastic deformation. The protective sleeve 49, in this case, comprises on the inside a ring-shaped indentation in which the latching ring lies in the protective position 50. Consequently, when the protective sleeve 49 is displaced in the direction of the sharpening position 52, a retaining force, which is applied as a result of the elastic deformation of the latching ring 56 and/or of the protective sleeve 49, has to be overcome such that unintentional displacement of the protective sleeve 49 is effectively prevented.

Figure 4:
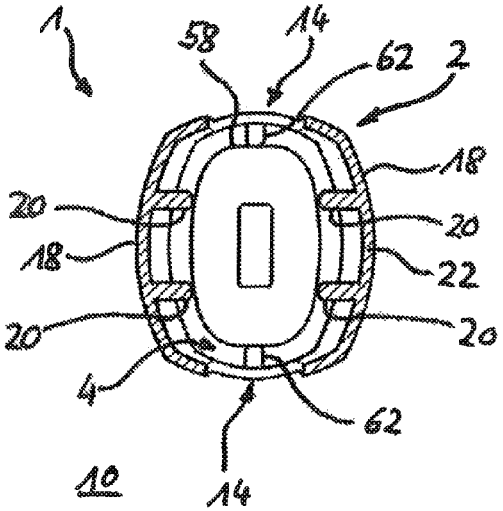
FIGS. 4 and 5 show a view according to FIG. 3 of the pencil holder with a pencil with an oval or triangular profile inserted therein.
Figure 5:
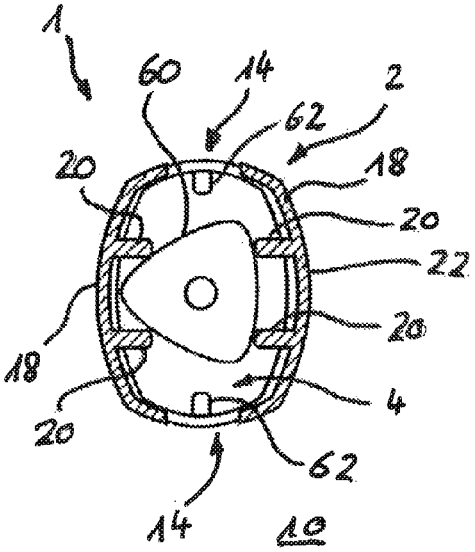

As shown in FIG. 4 and FIG. 5, when the pencil is inserted, shown in FIG. 4 as a carpenter pencil 58 with an oval cross section, in FIG. 5 as a "jumbo pen 60" with a triangular cross section, the retaining tongues 18 are bent out toward the outside 10. The clamping webs 20 which are located opposite one another in pairs, in this case, abut against the carpenter pencil 58 or the jumbo pencil 60 in such a manner that the two pencils, irrespective of their profile, are held almost centered in the pencil holder 1 and so as to be tilt-resistant. As an alternative to the profiles of the carpenter pencil 58 and of the jumbo pencil 60 shown in FIG. 4 and FIG. 5, however, as a result of the development of the clamping webs 20 other pencil profiles such as, for example, round or hexagonal profiles, can also be held in an equally centered and sturdy manner between the retaining tongues 18.

Two further webs are arranged in the interior 4 of the pencil holder 1 for using the pencil holder 1 with the carpenter pencil 58. Said webs are designated below as guide webs 62 and serve for guiding particularly long carpenter pencils 58 which are regularly inserted by way of their writing tip 64 down to the pointed end 12 and, in this case, also protrude with a long projection, i.e. by, for example, between 80 and 140 mm beyond the insertion end 6 of the pencil holder 1 (see FIG. 6). The guide webs 62 are aligned with their web height substantially perpendicular to the clamping webs 20 and guide the carpenter pencil 58 transversely with respect to the clamping webs 20 (see FIG. 4).

Figure 6:
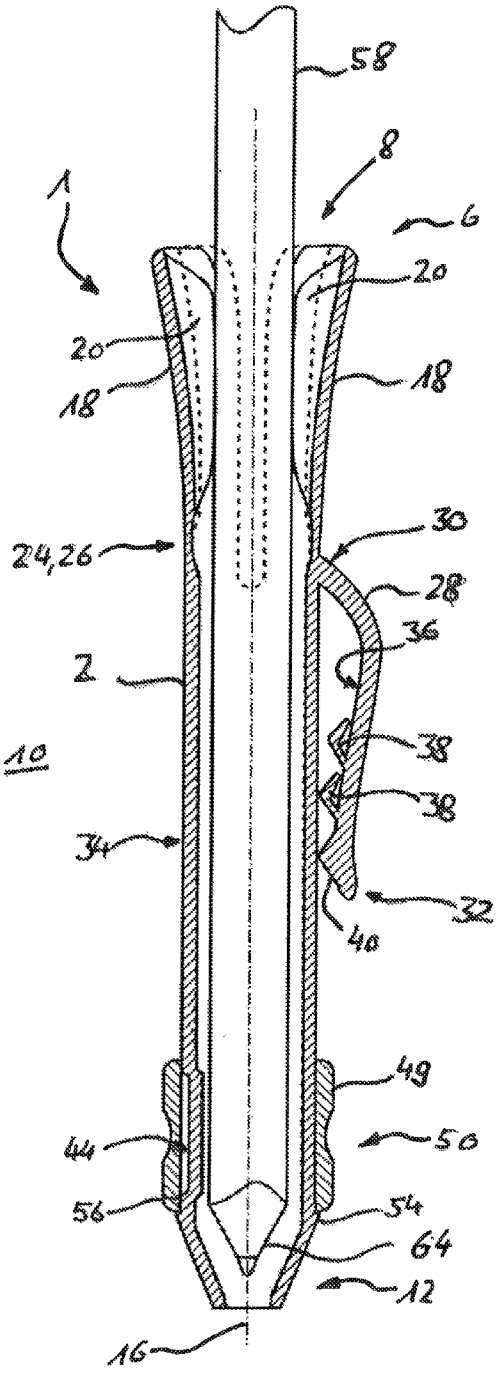
FIG. 6 shows a view according to FIG. 2 of an alternative exemplary embodiment of the pencil holder with a pencil inserted therein.
Figure 7:
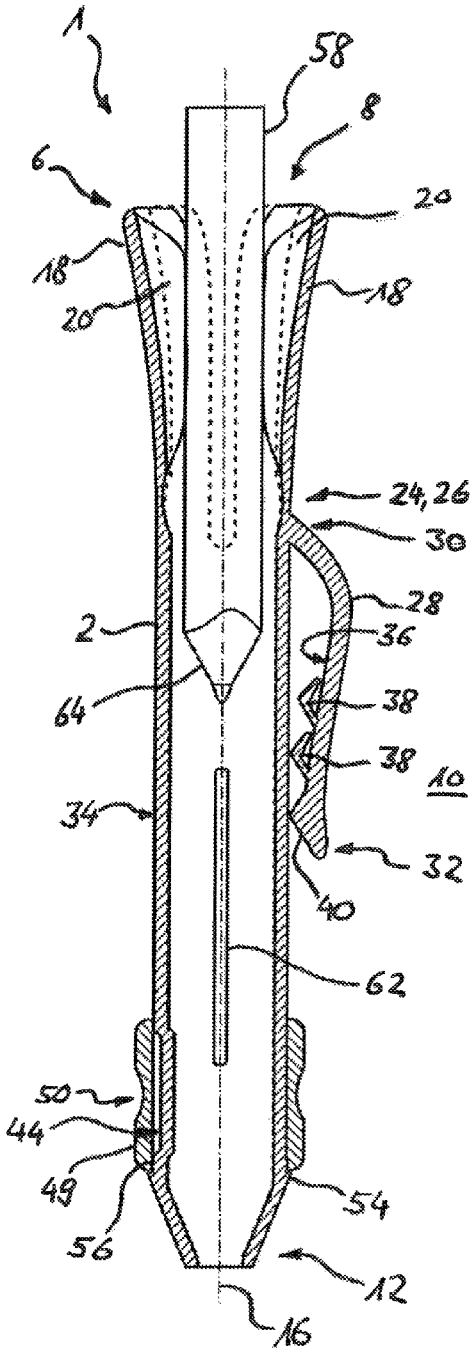
FIG. 7 shows a view according to FIG. 6 of the pencil holder with a pencil that is shortened compared to FIG. 6.

The exemplary embodiment of the pencil holder 1 shown in FIGS. 6 and 7 is developed structurally in a substantially identical manner to the exemplary embodiment described in FIGS. 1 to 5. In contrast thereto, however, the pencil holder 1 according to FIGS. 6 and 7 comprises a pointed end 12 that is breached to the outside 10, that is an open pointed end.

In FIG. 6 the carpenter pencil 58 is inserted into the pencil holder 1 as an example in an almost non-shortened state. The carpenter pencil 58, in this case, reaches by way of its writing tip 64 right into the pointed end 12 of the pencil holder 1. At the opposite insertion end 6 the carpenter pencil 58 (shown by the solid line) protrudes beyond the pencil holder 1. For receiving the carpenter pencil 58 the retaining tongues 18 are bent out toward the outside 10 in relation to their normal state which is shown by the dotted line and abut against the carpenter pencil 58 by way of their clamping webs 20. In order to enable particularly good guiding of the carpenter pencil 58 at the start of the clamping webs 20, the clamping webs 20 are beveled toward the insertion opening 8.

In FIG. 7 a carpenter pencil 58, which is clearly shorter compared to the carpenter pencil 58 shown in FIG. 6, is inserted into the pencil holder 1 as an example. In this connection, the effect of the retaining tongues 18 as well as of the clamping webs 20 is particularly clear. The carpenter pencil 58 reaches by way of its writing tip 64 only a short way beyond the retaining tongue 18 into the region of the interior 4 which is closed over its entire surface. The carpenter pencil 58 also projects in such a manner slightly beyond the insertion end 6 of the pencil holder 1 such that the carpenter pencil 58 is still able to be gripped and does not disappear completely into the pencil holder 1. The carpenter pencil 58, in this connection, is held completely by the retaining tongues 18 and is aligned in a centered manner in relation to the longitudinal axis 16 by the clamping webs 20. As a result of the clamping webs 20 which are arranged parallel to one another, the carpenter pencil 58 is also prevented from tilting. On account of said arrangement of the clamping webs 20, in addition almost all pencil profiles are able to be held equally aligned in the longitudinal direction between the retaining tongues 18 at the depth of insertion desired by the user with reference to the insertion end 6.

Figure 8:
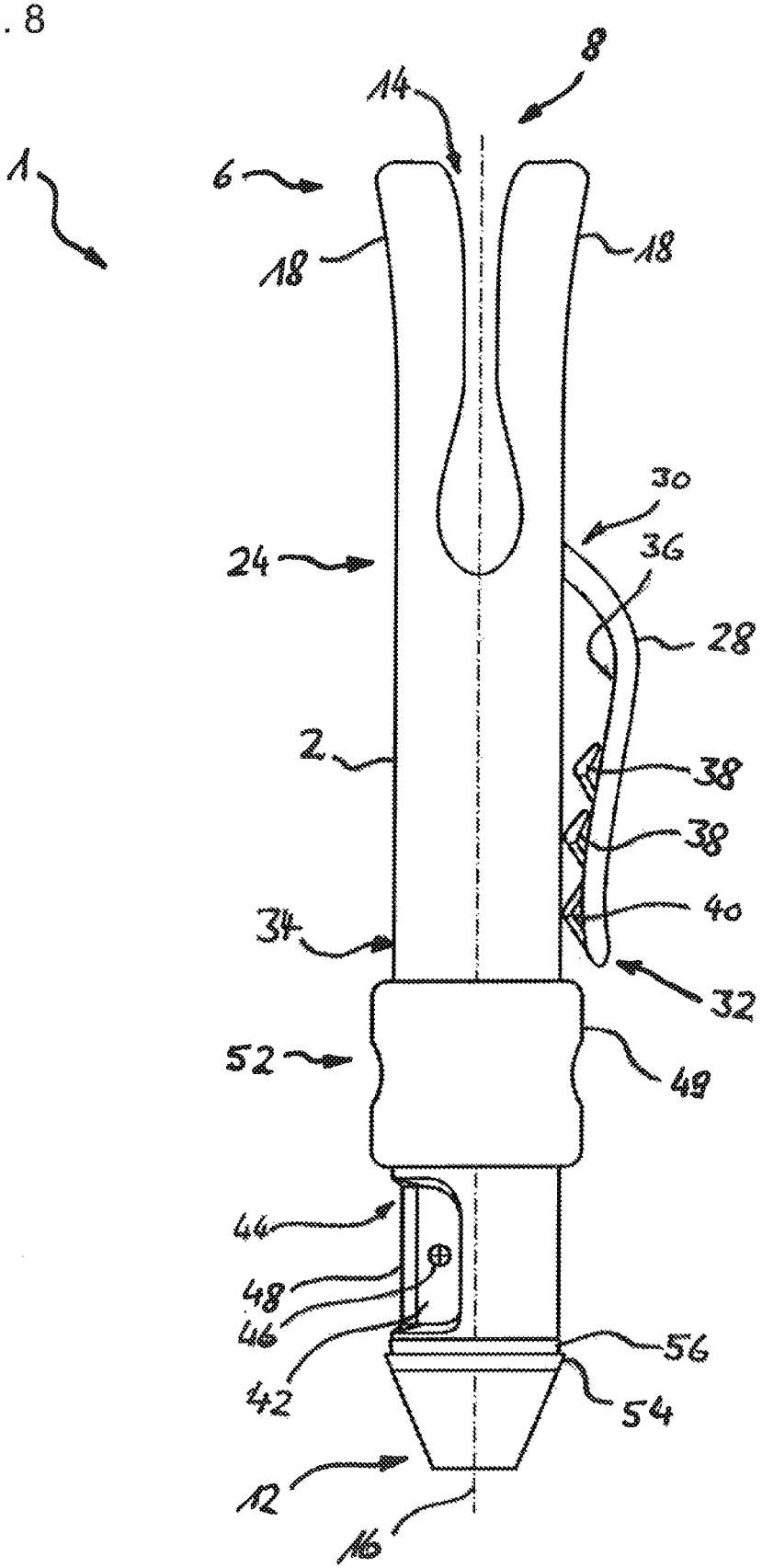
FIG. 8 shows a view according to FIG. 1 of a further exemplary embodiment of the pencil holder.

FIG. 8 shows a further exemplary embodiment of the pencil holder 1. To increase the elasticity of the flexible tongues 18, the longitudinal slots 14, in this connection, are widened in a droplet-shaped manner in the region of their end 24 such that the retaining tongues 18 are made narrower in said region in the circumferential direction. As a result, the profile of the retaining tongues 18, which is approximately U-shaped when viewed in cross section (cf. FIG. 3), is weakened for bending to the rear side of the "U", i.e. in the direction opposite the free legs of the U.

FIG. 8 shows the protective sleeve 49 in addition in its sharpening position 52. In said representation it is clear that the cutting edge 48 of the sharpening blade 42 is accessible from the outside 10.

FIGS. 9 to 15 show a further exemplary embodiment of the pencil holder 1. The overall length L of the pencil holder 1, in this connection, is 24 centimeters and consequently corresponds to the length of a traditional collapsed folding rule. The fastening bracket 28 is fastened by way of its fixed end 30 in the region of the insertion end 6 on one of the retaining tongues 18. The distance between the fixed end 30 and the insertion end 6, in this case, is small in comparison to the length of the fastening bracket 28. As a result, the pencil holder 1 hardly projects beyond the edge of a pocket of the work garment—in the event of it being pushed into such a pocket and being secured at the edge thereof by way of the fastening bracket 28.

Figure 9:
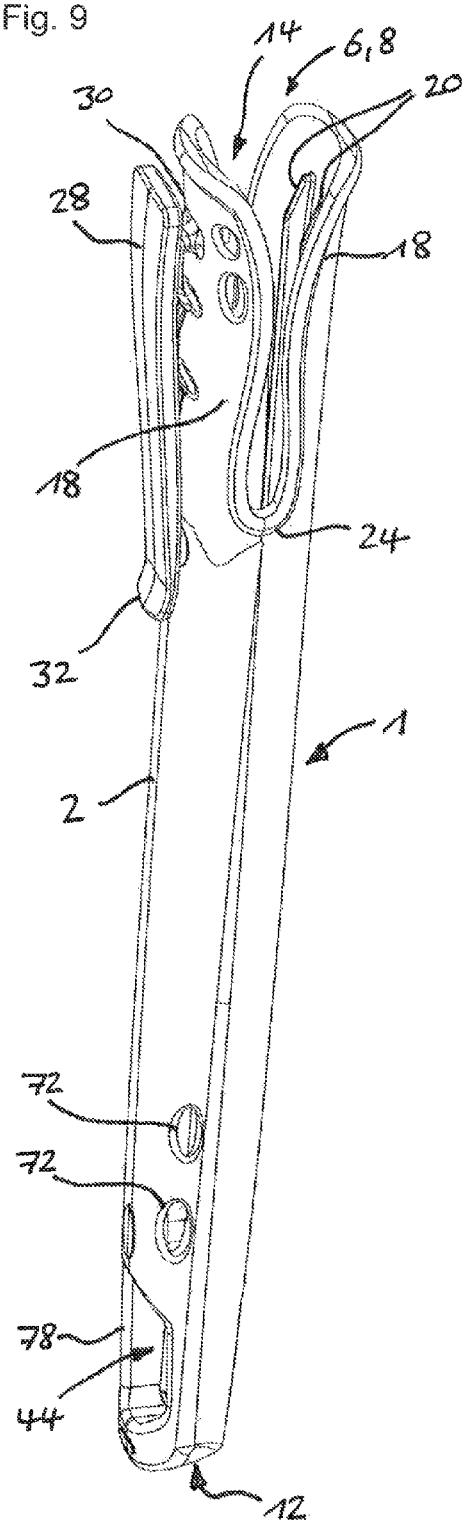
FIG. 9 shows a perspective view of a further exemplary embodiment of the pencil holder
Figure 10:
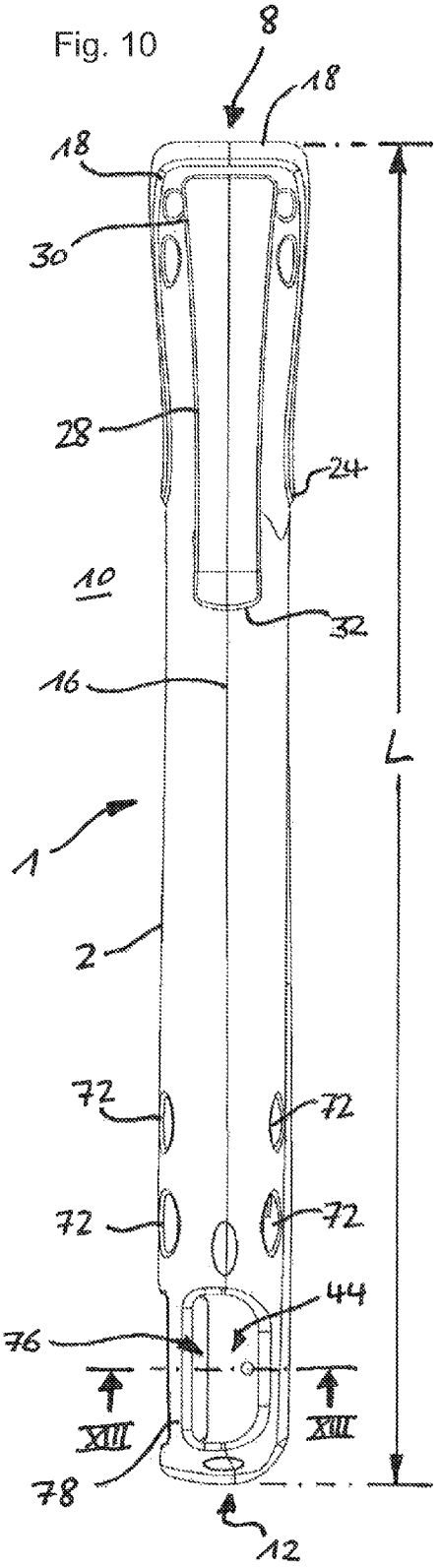
FIGS. 10 and 11 show in each case different side views of the pencil holder according to FIG. 9.
Figure 11:
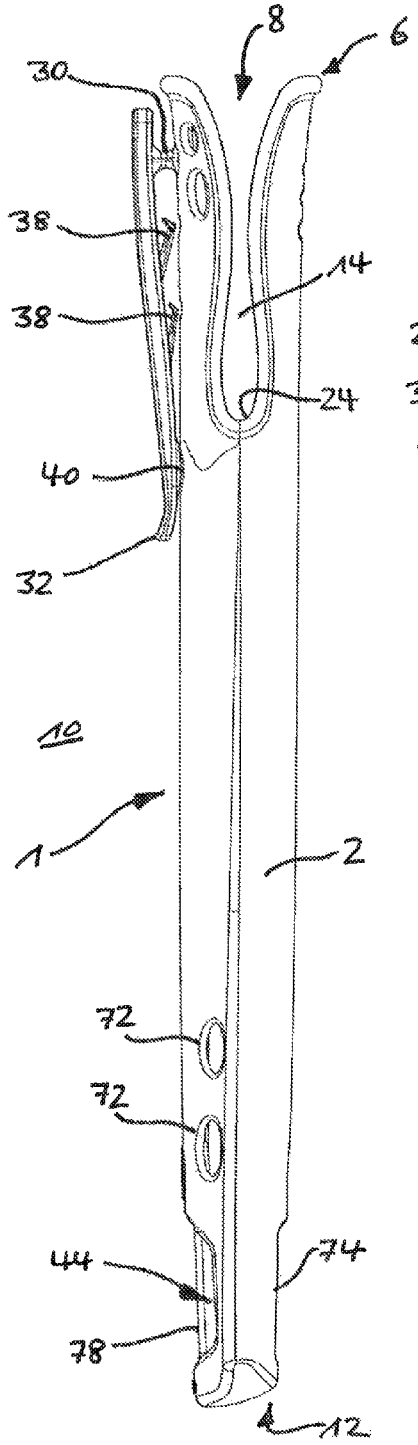
Figure 12:
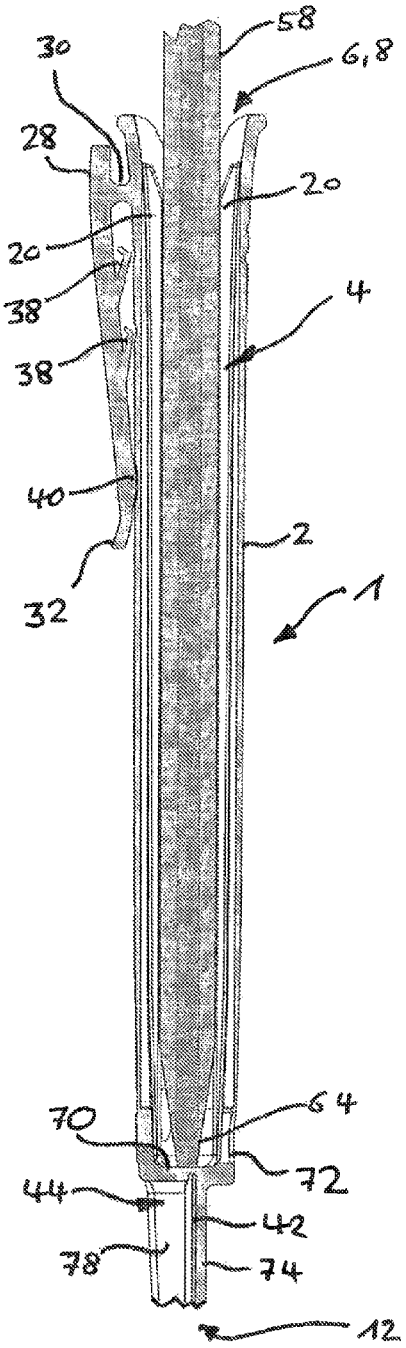
FIG. 12 shows a view according to FIG. 2 of the pencil holder according to FIG. 9, FIGS. 13 and 14 show a cross section XIII-XIII according to FIG. 10 of the pencil holder according to FIG. 9.
Figure 13:
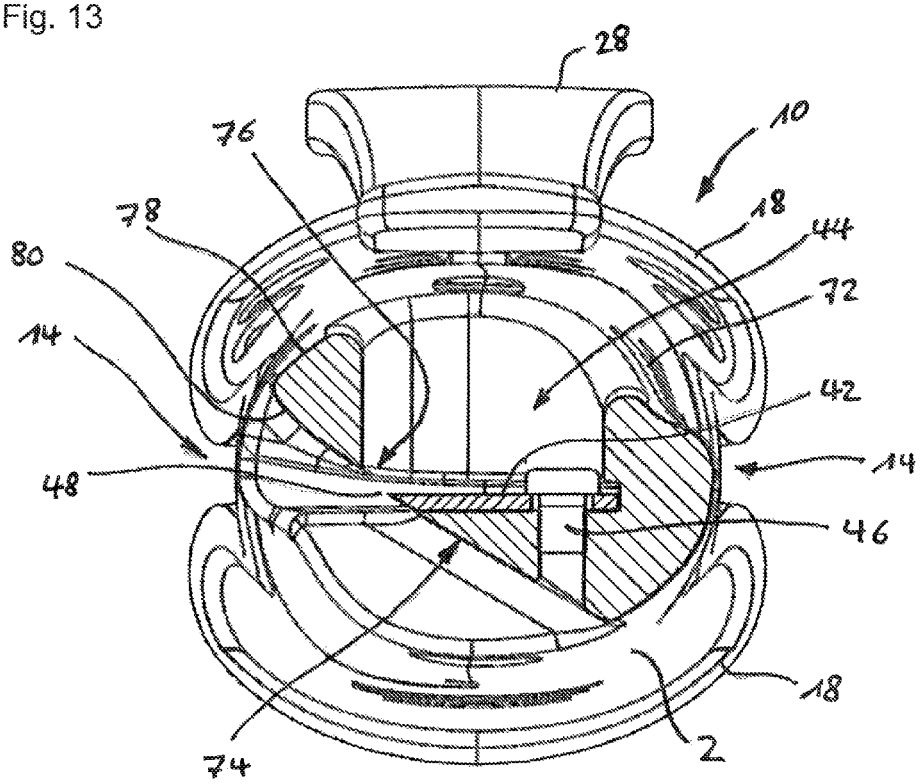
Figure 14:
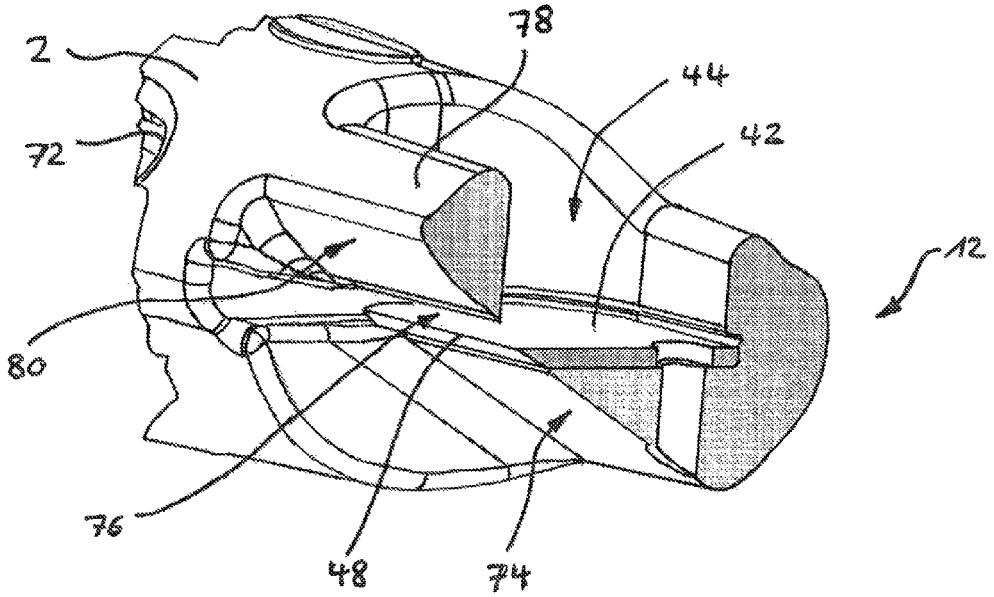
Figure 15:
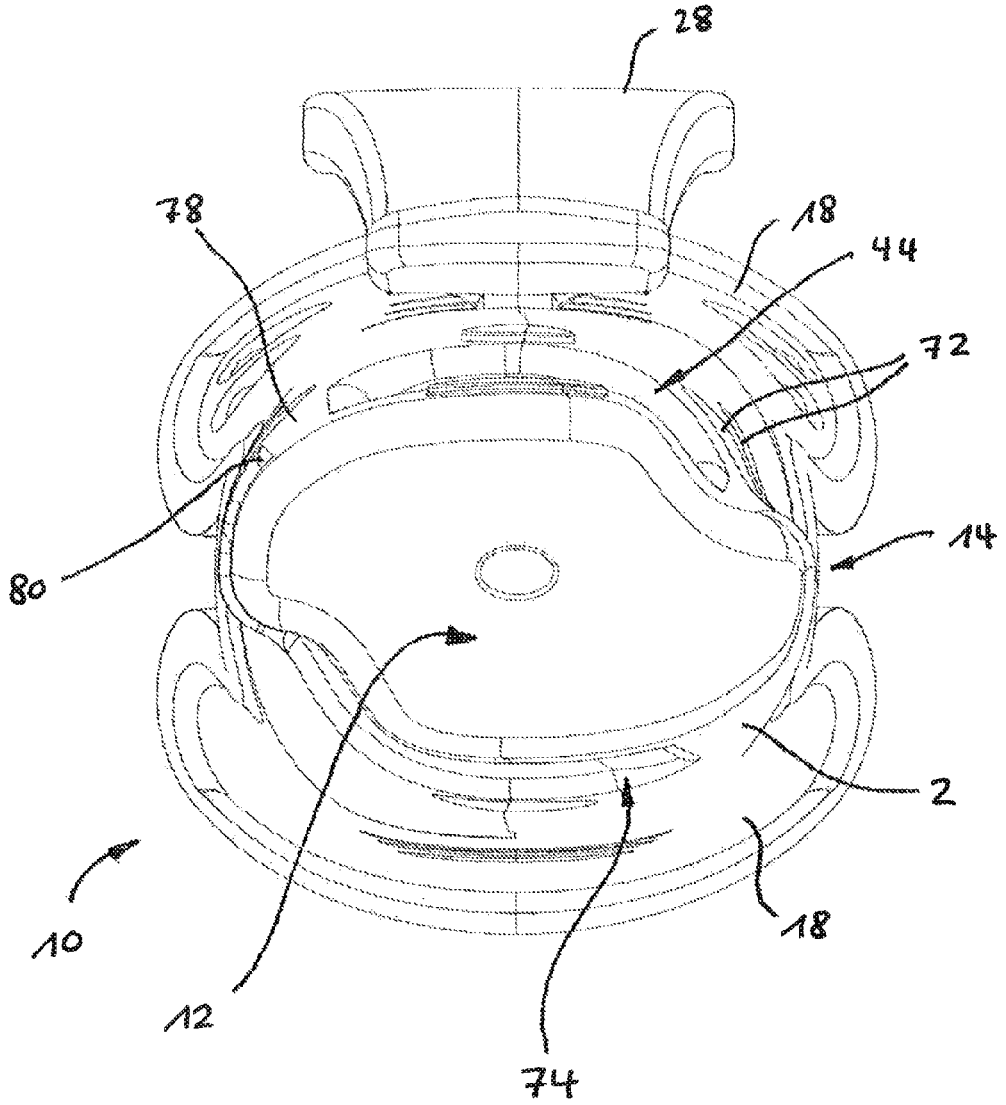
FIG. 15 shows a view onto the tip of the pencil holder according to FIG. 9.

As can be seen in FIG. 9 and FIG. 12, the clamping webs 20 extend (in contrast to the aforementioned exemplary embodiments) from the retaining tongues 18 over the entire (inside) length of the interior 4 up to a bottom 70 (arranged in the region of the pointed end 12) of the interior 4. The carpenter pencil 58, in this case, abuts over almost its entire length inserted into the pencil holder 1 (namely with the exception of its tapered writing tip 64) against the clamping webs 20 and is consequently supported in a tilt-resistant manner.

Several windows 72, by means of which the interior 4 communicates with the outside 10, are formed in the outer surface 34 in the region of the pointed end 12, definitively in the region of the bottom 70 of the interior 4. Dirt and/or liquid that has penetrated into the interior 4 by means of the insert opening 8 can, where applicable, pass out of the interior 4 to the outside through said windows 72 such that the dirt and/or the liquid does not collect in the interior.

The pointed end 12 serves in a region mounted upstream of the bottom 70 for receiving the sharpening blade 42. The depression 44, in which the sharpening blade 42 lies when assembled as specified according to FIGS. 12 to 14, reaches, in this connection, precisely or at least approximately up to half the cross section of the basic body 2. On the oppositely situated side of the basic body 2 an inclined contact surface 74—once again in the manner of a depression—is formed in the cylinder-like basic body 2. The depression 44, in this case, communicates by means of a passage 76 with the side of the basic body 2 that bears the contact surface 74. When assembled as specified, the cutting edge 48 of the sharpening blade 42 lies in said passage 76. The passage 76 as well as the depression 44 are additionally defined toward the outside 10 by a frame web 78 which extends parallel to the longitudinal axis 16. The frame web 78, in this case, is arranged in such a manner that the cutting edge 48 is only accessible from the contact surface 74 for sharpening the pencil 58. On its side that faces the contact surface 74, the frame web 78 comprises an even or lightly spherical guide surface 80 which is parallel to the contact surface 74 and set back slightly in relation to said contact surface. Consequently, a step, which is provided with a slot, is formed between the contact surface 74 and the guide surface 80. The cutting edge 48 lies in the slot formed between the guide surface 80 and the contact surface 74 in particular in such a manner that it (and in particular its free surface) is in alignment with the contact surface 74.

The offset of the guide surface 80 with respect to the contact surface 74, and consequently the "height" of the named step predefines a cutting thickness in the manner of a plane or potato peeler (shaving thickness), therefore limits the maximum material thickness to be shaved from the carpenter pencil 58 in one pull. For sharpening, the carpenter pencil 58 is placed onto the guide surface 80 of the frame web 78 and is pulled over the contact surface 74. The cutting edge 48, in this case, comes into contact with the pencil and shaves a shaving off said pencil.

The height of the step between the guide surface 80 and the contact surface 74 is chosen in such a manner that a sufficiently high degree of safety is provided, that a user does not cut himself on the sharpening blade 42 when moving a finger over the guide surface 80 and the contact surface 74. The frame web 78 consequently serves both for the protection of the sharpening blade 42 and as a spacer for defining the shaving thickness. During sharpening, the passage 76 and the depression 44 serve as an ejection window (shaving ejection window) for the removed shavings.

The object of the invention proceeds in a particularly clear manner from the exemplary embodiments described above. Nevertheless, the object of the invention, however, is not restricted to said exemplary embodiments. Rather, further embodiments of the invention can be derived from the above description by the expert. In particular, the individual features of the invention which are described by way of the different exemplary embodiments and the development variants thereof are also able to be combined with one another in a different manner.

| List of references | |
|---|---|
| 1 | Pencil holder |
| 2 | Basic body |
| 4 | Interior |
| 6 | Insertion end |
| 8 | Insertion opening |
| 10 | Outside |
| 12 | Pointed end |
| 14 | Longitudinal slot |

-continued

| List of references | |
|---|---|
| 16 | Longitudinal axis |
| 18 | Retaining tongue |
| 20 | Clamping web |
| 22 | Wall |
| 24 | End |
| 26 | Wall thickness tapering |
| 28 | Fastening bracket |
| 30 | Fixed end |
| 32 | Free end |
| 34 | Outer surface |
| 36 | Inside surface |
| 38 | Blocking element |
| 40 | Retaining lug |
| 42 | Sharpening blade |
| 44 | Depression |
| 46 | Clamping screw |
| 48 | Cutting edge |
| 49 | Protective sleeve |
| 50 | Protective position |
| 52 | Sharpening position |
| 54 | Collar |
| 56 | Latching ring |
| 58 | Carpenter pencil |
| 60 | Jumbo pencil |
| 62 | Guide web |
| 64 | Writing tip |
| 70 | Bottom |
| 72 | Window |
| 74 | Contact surface |
| 76 | Passage |
| 78 | Frame web |
| 80 | Guide surface |

The invention claimed is:

1. A pencil holder for storing a pencil, the pencil holder comprising:

a hollow, sleeve-shaped basic body formed with an interior that is elongated along a longitudinal axis and that opens out in an insertion opening for partially receiving the pencil;

at least one retaining tongue formed on said basic body at said insertion opening, said basic body transitioning into said at least one retaining tongue jutting out from said basic body and configured for holding the pencil on said basic body by clamping the pencil;

an outer surface of said basic body being formed with a depression, and a sharpening blade being fastened in said depression with a cutting edge thereof aligned substantially parallel to the longitudinal axis and accessible from outside said basic body for sharpening the pencil.

2. The pencil holder according to claim 1, wherein said at least one retaining tongue is one of at least two retaining tongues and said basic body transitions into said at least two retaining tongues disposed opposite one another and configured for clampingly holding the pencil therebetween.

3. The pencil holder according to claim 1, further comprising a fastening bracket connected to said basic body by way of a fixed end and aligned by way of a free end, which is remote from said fixed end, in a direction of a pointed end of said basic body remote from an insertion end at said insertion opening.

4. The pencil holder according to claim 3, wherein said fastening bracket is fastened by way of said fixed end on said retaining tongue or on one of at least two said retaining tongues.

5. The pencil holder according to claim 1, wherein said at least one retaining tongue is bent out at an insertion end at said insertion opening for enlarging said insertion opening in a funnel shape.

6. The pencil holder according to claim 1, wherein said at least one retaining tongue is tapered in portions between a transition to said basic body and a free end thereof.

7. The pencil holder according to claim 1, wherein said at least one retaining tongue is formed on an inside with at least one retaining projection for retaining the pencil.

8. The pencil holder according to claim 7, wherein said retaining tongue is formed on an inside with two retaining projections which, when viewed in the longitudinal direction, are arranged side by side.

9. The pencil holder according to claim 7, wherein said retaining projection is elongated in a direction parallel to the longitudinal axis of said basic body.

10. The pencil holder according to claim 9, wherein said retaining projection, proceeding from the respective said retaining tongue, extends over more than 50% of a length of said interior.

11. The pencil holder according to claim 1, wherein said basic body has an oval cross section.

12. The pencil holder according to claim 1, further comprising a blade cover for selectively covering said sharpening blade.

13. The pencil holder according to claim 12, wherein said blade cover is movably fastened on said basic body.

14. The pencil holder according to claim 13, further comprising at least one stop formed on said basic body and disposed such that said blade cover abuts in a protective position with the sharpening blade being covered.

15. The pencil holder according to claim 1, wherein said depression is formed in a region of a pointed end of said basic body remote from said insertion opening.

16. The pencil holder according to claim 15, wherein said depression communicates by way of a passage with a contact surface that is molded into said basic body on a rear side of said depression, for positioning the pencil to be sharpened, and wherein said cutting edge of said sharpening blade is accessible at the contact surface for sharpening the pencil.

17. The pencil holder according to claim 16, wherein said cutting edge of said sharpening blade has mounted upstream thereof a frame web that extends substantially in the longitudinal direction of the basic body and by way of which a cutting thickness of the sharpening blade is predefined.

18. The pencil holder according to claim 1, wherein the interior communicates with the outside of said basic body by way of at least one window which is formed in an outer surface of said basic body in a region of a pointed end of said basic body that is remote from said insertion opening.

* * * * *